US006236961B1

(12) United States Patent
Ozawa

(10) Patent No.: US 6,236,961 B1
(45) Date of Patent: May 22, 2001

(54) SPEECH SIGNAL CODER

(75) Inventor: Kazunori Ozawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/046,159

(22) Filed: Mar. 23, 1998

(30) Foreign Application Priority Data

Mar. 21, 1997 (JP) ..... 9-067637

(51) Int. Cl.[7] ..... G10L 3/02; G10L 9/00

(52) U.S. Cl. ..... 704/221; 704/219; 704/220; 704/222; 704/223; 704/230

(58) Field of Search ..... 704/221, 222

(56) References Cited

U.S. PATENT DOCUMENTS 5,787,389 * 7/1998 Taumi et al. ..... 704/222
5,806,024 * 9/1998 Ozawa ..... 704/222

OTHER PUBLICATIONS

Gonzalez–Prelcic N. et al: "A Multipulse–Like Wavelet–Based Speech Coder"—Applied Signal Processing, 1996, Springer–Verlag, UK, vol. 3, No. 2, pp. 78–87.
Kondoz A M et al.: "Speech Coding at 9.6 KB/S and Below Using Vector Quantized Tranform Coder"—Area Communication, Stockholm, Jun. 13–17, 1988 No. Conf. 8, Jun. 13, 1988, pp. 36–39, Institute of Electrical and Electronics Engineers.
Sreevivas T V: "Modelling LPC–Residue B Components for Good Quality Speech Coding"—ICASSP 88: 1988 International Conference on Acoustics, Speech, and Signal Processing (CAT. No. 88CH2561–9), New York, NY, USA, Apr. 11–14, 1988, pp. 171–174, vol. 1, New York, NY, USA, IEEE, USA.
T. Moriya, et al., "Transform Coding of Speech Using A Weighted Vector Quantizer" Journal on Selected Areas in Communications, vol. 6, No. 2, Feb. 1988, pp. 425–431.
N. Iwakami, et al., "High–Quality Audio–Coding At Less Than 64 Kbit/s, By Using Transform–Domain Weighted Interleave Vector Quantization (TWINVQ)", IEEE, 1995, pp. 3095–3098.
N. Sugamura, et al., "Speech Data Compression by LSP Speech Analysis–Synthesis Technique", The Trans. of IECE Japan, vol. J64–A, No. 8, Aug. 1981, pp. 599–606.
T. Nomura, et al., "LSP Coding Using VQ–SVQ With Interpolation in 4.075 kbps M–LCELP Speech Coder", Proc. of First International Workshop on Mobile Multimedia Communications, Dec. 7–10, 1993, at Waseda University, Tokyo, Japan, Session B.2.5, pp. 27–29.
P. Kroon, et al., "Pitch Predictors With High Temporal Resolution", 1990 Intl. Conference on Acoustics, Speech, and Signal Processing, Apr. 3–6, 1990, Albuquerque Convention Center, vol. 2, Speech Processing 2 VLSI Audion and Electroacoustics, pp. 661–664.
J.M. Tribolet, et al., "Frequency Domain Coding of Speech", IEEE Transactions of Acoustics, Speech, and Signal Processing, vol. ASSP–27, No. 5, Oct. 1979, 512–530.
Nakamizo, "Signal Analysis and System Identification", Corona Co., Ltd., 1998, pp. 82–87.

* cited by examiner

*Primary Examiner*—Krista Zele
*Assistant Examiner*—Robert Louis Sax
(74) *Attorney, Agent, or Firm*—Ostrolenk, Faber, Gerb & Soffen, LLP

(57) ABSTRACT

The spectral or pitch parameters of a speech signal are quantized, and impulse responses thereof are predicted by using a filter. An orthogonal transform is made of the speech signal, or a signal derived therefrom, or of the impulse responses or signals derived therefrom. The result of the orthogonal transform is entirely or partly quantized to obtain a plurality of pulses. More preferably, these pulses are retrieved recurrently by also using codevectors retrieved from a codebook or collectively quantizing their senses or amplitudes. This method optimizes speech signal coding.

14 Claims, 8 Drawing Sheets

SPEECH SIGNAL CODER

BACKGROUND OF THE INVENTION

The present invention relates to a speech signal coder for coding a speech signal of speech, music and so forth, and more particularly, to a signal coder capable of permitting high quality coding at low bit rate quantization.

Methods of efficiently coding a speech signal spectrum on a frequency axis are well known in the art as disclosed in, for instance, T. Moriya, "Transform coding of speech using a weighted vector quantizer" and N. Iwakami, "High-quality audio-coding at less than 64 kbit/s using transform-domain weighted interleave vector quantization (TWINVQ)".

In these methods, DCT (Discrete Cosine Transform) coefficients of the speech signal are obtained by making an orthogonal transform thereof based on DCT for a number N of different points.

The DCT coefficient are then m divided at a number ($M \leqq N$) of points. The speech signal is then vector quantized by making a codebook retrieval for each of the M division points.

However, these prior art signal coders had the following problems in the speech signal coding.

Firstly, DCT coefficients of N points are all quantized uniformly. Therefore, reducing the bit number of a vector quantizer to reduce the bit rate, leads to the difficulty of obtaining satisfactory DCT coefficients which have a perceptually important role. In other words, although relatively satisfactory speech quality is obtainable by high bit rate coding, reducing the bit rate leads to extreme deterioration of the speech signal quality.

A second problem is posed by increasing the number M of points of the DCT coefficient division to improve the efficiency of vector quantization. Increasing the number M of points of the DCT coefficient division results in an increase of the dimension number of the vector quantizer. The dimension number exponentially increases the computational effort necessary for the vector quantization, and makes it impossible to reduce the bit rate.

SUMMARY OF THE INVENTION

The invention was made in view of the above problems, and an object of the invention is to provide a signal coder capable of coding of excellent speech quality at a low bit rate by quantizing speech signals having high frequency components with less computational effort.

According to the invention, there is provided a signal coder for coding speech signal comprising: parameter calculating means for calculating spectral and pitch parameters from speech signal and quantizing the calculated parameters; impulse response calculating means for calculating impulse responses of at least either of the quantized spectral or pitch parameters by using a filter constituted thereby; first orthogonal transfer means for obtaining a first transform signal by performing orthogonal transform of the speech signal or a signal derived therefrom using inverse filtering according to the quantized spectral and pitch parameters; second orthogonal transform means for obtaining a second transform of the predicted impulse response or a signal derived therefrom; and pulse quantizing means for quantizing the first transform signal either entirely or partly using the second transform signal.

The pulse quantizing means includes a first retrieval unit for performing determination of a first pulse group of a plurality of pulses recurrently according to the pitch parameters, and a second retrieval unit for making determination of a second pulse group according to the second transform signal, the signal coder further comprising a selector for selecting either the first or the second pulse group that represent the first transform signal.

The pulse quantizing means obtains the plurality of pulses by also using codevectors by retrieval of a codebook.

The pulse quantizer simultaneously quantizes the polarity or amplitude of at least one of the plurality of pulses.

According to another aspect of the present invention, there is provided a speech signal coder comprising: a first means for extracting a spectrum information and pitch information from a frame input speech signal; a second means for determining an impulse response signal of a filter defined by the spectrum information and pitch information; a third means for determining a response signal of a filter defined by the spectrum information and pitch information with an input signal; a fourth means for producing a difference signal between a perceptually weighted signal of the input speech signal and the response signal; a fifth means which receives the difference signal and has a filter defined by the spectrum information and pitch information; a sixth means for performing an orthogonal transform of the output of the fifth means and producing a first transform signal; a seventh means for performing an orthogonal transform of the impulse response signal and producing a second transform signal; an eighth means for determining a predetermined number of pulse positions on the basis of the first and second transform signals; a ninth means for determining a gain code vector using a gain codebook on the basis of the first and second transform signals, and determined pulse position data; a tenth means for determining an excitation signal on the basis of the gain code vector and determined pulse; an eleventh means for performing inverse-orthogonal transform of the excitation signal and producing as a first inverse-orthogonal; and a twelfth means for outputting a response signal based on the first inverse-orthogonal transform signal, spectrum information and pitch information as the input signal of the third means.

According to other aspect of the present invention, there is provided a speech signal coder comprising: a first means for extracting a spectrum information and pitch information from a frame input speech signal; a second means for determining an impulse response signal of a filter defined by the spectrum information and pitch information; a third means for determining a response signal of a filter defined by the spectrum information and pitch information with an input signal; a fourth means for producing a difference signal between a perceptually weighted signal of the input speech signal and the response signal; a fifth means which receives the difference signal and has a filter defined by the spectrum information and pitch information; a sixth means for performing an orthogonal transform of the output of the fifth means and producing a first transform signal; a seventh means for performing an orthogonal transform of the impulse response signal and producing a second transform signal; an eighth means for determining a predetermined number of pulse positions on the basis of the first and second transform signals and determining an amplitude codevector by using an amplitude codebook; a ninth means for determining a gain code vector using a gain codebook on the basis of the first and second transform signals, and determined pulse position data; a tenth means for determining an excitation signal on the basis of the gain code vector and determined pulse; an eleventh means for performing inverse-orthogonal transform of the excitation signal and producing as a first inverse-orthogonal signal; and a twelfth means for outputting a response signal based on the first inverse-orthogonal transform signal, spectrum information and pitch information as the input signal of the third means.

According to still another aspect of the present invention, there is provided a speech signal coder comprising: a first means for extracting a spectrum information and pitch information from a frame input speech signal; a second means for determining an impulse response signal of a filter defined by the spectrum information; a third means for determining a response signal of a filter defined by the spectrum information and pitch information with an input signal; a fourth means for producing a difference signal between a perceptually weighted signal of the input speech signal and the response signal; a fifth means which receives the difference signal and has a filter defined by the spectrum information and pitch information; a sixth means for performing an orthogonal transform of the output of the fifth means and producing a first transform signal; a seventh means for performing an orthogonal transform of the impulse response signal and producing a second transform signal; an eighth means for determining a first group of a predetermined number of pulse positions on the basis of the first and second transform signals and a second group of predetermined number of pulses on the basis of the determined pitch information; a ninth means for selecting one of the pulse groups having smaller distortion; a tenth means for determining a gain code vector using a gain codebook on the basis of the first and second transform signals, and selected pulse group data; an eleventh means for determining an excitation signal on the basis of the gain code vector and determined pulse; a twelfth means for performing inverse-orthogonal transform of the excitation signal and producing as a first inverse-orthogonal signal; and a thirteenth means for outputting a response signal based on the first inverse-orthogonal transform signal, spectrum information and pitch information as the input signal of the third means.

According to still other aspect of the present invention, there is provided a speech signal coder comprising: a first means for extracting a spectrum information and pitch information from a frame input speech signal; a second means for determining an impulse response signal of a filter defined by the spectrum information; a third means for determining a response signal of a filter defined by the spectrum information and pitch information with an input signal; a fourth means for producing a difference signal between a perceptually weighted signal of the input speech signal and the response signal; a fifth means which receives the difference signal and has a filter defined by the spectrum information and pitch information; a sixth means for performing an orthogonal transform of the output of the fifth means and producing a first transform signal; a seventh means for performing an orthogonal transform of the impulse response signal and producing a second transform signal; an eighth means for retrieving a first group of a predetermined number of pulse positions on the basis of the first and second transform signals using amplitude codebook and a second group of predetermined number of pulses on the basis of the determined pitch information by using an amplitude codebook; a ninth means for selecting one of the pulse groups having smaller distortion by using an amplitude codebook; a tenth means for determining a gain code vector using a gain codebook on the basis of the first and second transform signals, and selected pulse group data; an eleventh means for determining an excitation signal on the basis of the gain code vector; a twelfth means for performing inverse-orthogonal transform of the excitation signal and producing as a first inverse-orthogonal signal; and a thirteenth means for outputting a response signal based on the first inverse-orthogonal transform signal, spectrum information and pitch information as the input signal of the third means.

According to other aspect of the present invention, there is provided a speech signal coder comprising: a first means for extracting a spectrum information and pitch information from a frame input speech signal; a second means for determining an impulse response signal of a filter defined by the spectrum information and pitch information; a third means for determining a response signal of a filter defined by the spectrum information and pitch information with an input signal; a fourth means for producing a difference signal between a perceptually weighted signal of the input speech signal and the response signal; a fifth means which receives the difference signal and has a filter defined by the spectrum information and pitch information; a sixth means for performing an orthogonal transform of the output of the fifth means and producing a first transform signal; a seventh means for performing an orthogonal transform of the impulse response signal and producing a second transform signal; an eighth means for determining a predetermined number of pulse positions on the basis of the first and second transform signals by using an excitation codebook; a ninth means for determining a gain code vector by using a gain codebook on the basis of the first and second transform signals, and determined pulse position data; a tenth means for determining an excitation signal on the basis of the gain code vector; an eleventh means for performing inverse-orthogonal transform of the excitation signal and producing as a first inverse-orthogonal signal; and a twelfth means for outputting a response signal based on the first inverse-orthogonal transform signal, spectrum information and pitch information as the input signal of the third means.

According to still other aspect of the present invention, there is provided a speech signal coder comprising: a first means for extracting a spectrum information and pitch information from a frame input speech signal; a second means for determining an impulse response signal of a filter defined by the spectrum information and pitch information; a third means for determining a response signal of a filter defined by the spectrum information and pitch information with an input signal; a fourth means for producing a difference signal between a perceptually weighted signal of the input speech signal and the response signal; a fifth means which receives the difference signal and has a filter defined by the spectrum information and pitch information; a sixth means for performing an orthogonal transform of the output of the fifth means and producing a first transform signal; a seventh means for performing an orthogonal transform of the impulse response signal and producing a second transform signal; an eighth means for determining a predetermined number of pulse positions on the basis of the first and second transform signals by using an amplitude codebook; a ninth means for determining a gain code vector using a gain codebook on the basis of the first and second transform signals, and determined pulse position data and amplitude codevector; a tenth means for determining an excitation signal on the basis of the gain code vector; an eleventh means for performing inverse-orthogonal transform of the excitation signal and producing as a first inverse-orthogonal signal; and a twelfth means for outputting a response signal based on the first inverse-orthogonal transform signal, spectrum information and pitch information as the input signal of the third means.

According to still other aspect of the present invention, there is provided a speech signal coder comprising: a first means for extracting a spectrum information and pitch information from a frame input speech signal; a second means for determining an impulse response signal of a filter defined by the spectrum information; a third means for determining a response signal of a filter defined by the spectrum information and pitch information with an input signal; a fourth means for producing a difference signal between a perceptually weighted signal of the input speech signal and the response signal; a fifth means which receives the difference signal and has a filter defined by the spectrum information and pitch information; a sixth means for performing an orthogonal transform of the output of the fifth means and producing a first transform signal; a seventh means for performing an orthogonal transform of the impulse response signal and producing a second transform signal; an eighth means for determining a first group of a predetermined number of pulse positions on the basis of the first and second transform signals and a second group of predetermined number of pulses on the basis of the determined pitch information; a ninth means for selecting one of the pulse groups having smaller distortion by using an excitation codebook; a tenth means for determining a gain code vector using a gain codebook on the basis of the first and second transform signals, and selected pulse group data; an eleventh means for determining an excitation signal on the basis of the gain code vector; a twelfth means for performing inverse-orthogonal transform of the excitation signal and producing as a first inverse-orthogonal signal; and a thirteenth means for outputting a response signal based on the first inverse-orthogonal transform signal, spectrum information and pitch information as the input signal of the third means.

According to still other aspect of the present invention, there is provided a speech signal coder comprising: a first means for extracting a spectrum information and pitch information from a frame input speech signal; a second means for determining an impulse response signal of a filter defined by the spectrum information; a third means for determining a response signal of a filter defined by the spectrum information and pitch information with an input signal; a fourth means for producing a difference signal between a perceptually weighted signal of the input speech signal and the response signal; a fifth means which receives the difference signal and has a filter defined by the spectrum information and pitch information; a sixth means for performing an orthogonal transform of the output of the fifth means and producing a first transform signal; a seventh means for performing an orthogonal transform of the impulse response signal and producing a second transform signal; an eighth means for retrieving a first group of a predetermined number of pulse positions on the basis of the first and second transform signals by using an amplitude codebook and a second group of predetermined number of pulses on the basis of the determined pitch information; a ninth means for selecting one of the pulse groups having smaller distortion by using an excitation codebook; a tenth means for determining a gain code vector using a gain codebook on the basis of the first and second transform signals, and selected pulse group data; an eleventh means for determining an excitation signal on the basis of the gain code vector; a twelfth means for performing inverse-orthogonal transform of the excitation signal and producing as a first inverse-orthogonal signal; and a thirteenth means for outputting a response signal based on the first inverse-orthogonal transform signal, spectrum information and pitch information as the input signal of the third means.

Other objects and features will be clarified from the following description with reference to attached drawings.

PREFERRED EMBODIMENTS OF THE INVENTION

Preferred embodiments of the invention will now be described will now be described with reference to the drawings.

Figure 1:
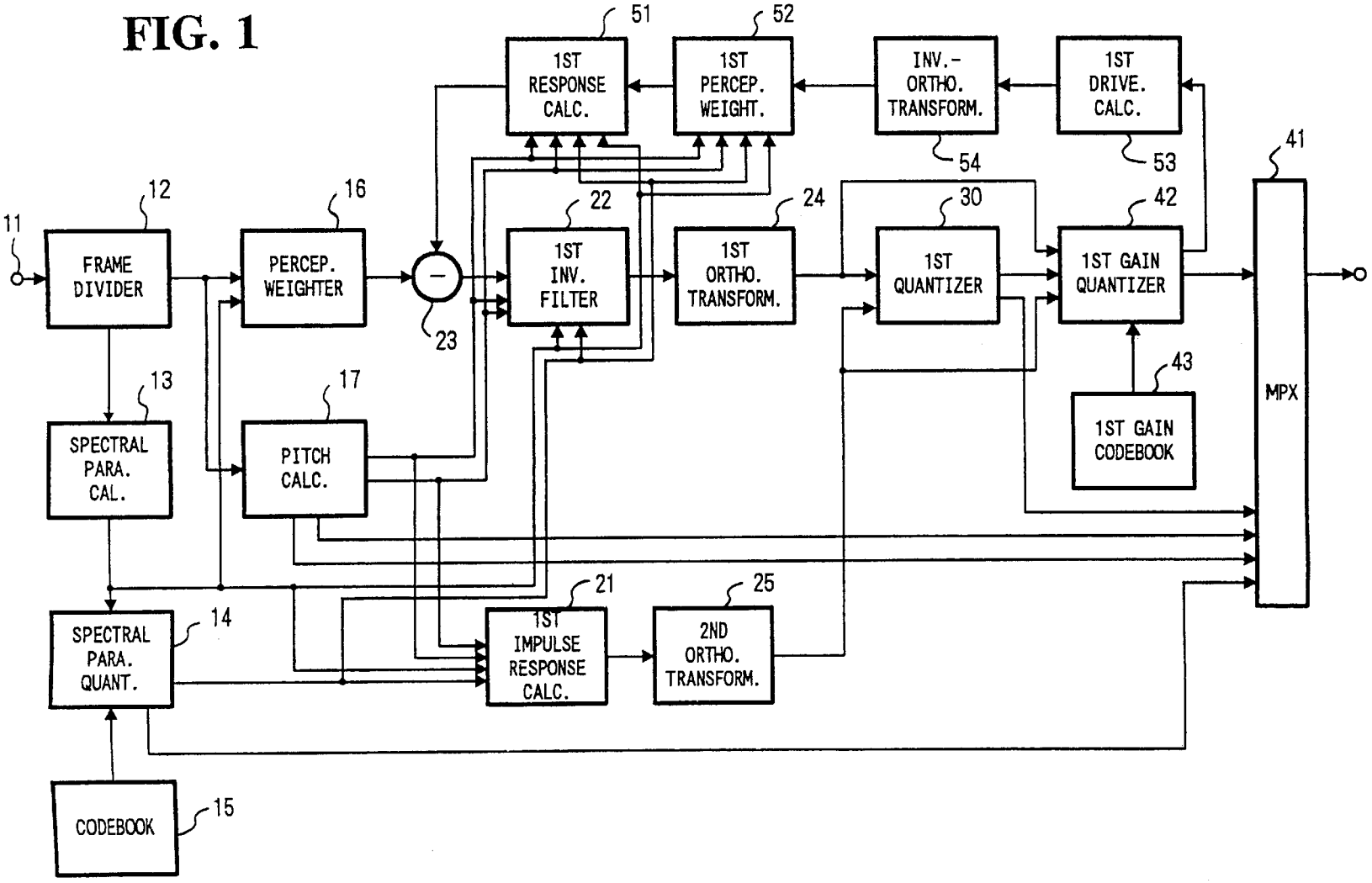
FIG. 1 is a block diagram showing a first embodiment of the invention.

FIG. 1 is a block diagram showing a first embodiment of the invention.

In this embodiment, a divider 12 preliminarily divides a speech signal supplied from an input terminal 11 into frames at a predetermined number N of points, and supplies the divided speech signal to a spectral parameter calculator 13, a pitch predictor 17 and a perceptual weight multiplier 16.

The LSP calculator 13 cuts out the speech from each frame speech signal by using a window longer than the frame length (for instance 24 ms), and calculates spectral parameters, such as LSP parameters, by a number corresponding to a predetermined number P of degrees (for instance 10).

The prediction of LSP parameters is performed by well-known means, such as LPC analysis or Burg analysis. In the following, a case of using the Burg analysis will be described. The Burg analysis is described in Nakamizo, "Signal analysis and system identification", Corona Co., Ltd., 1998, pp. 82–87, and is not herein described.

The LSP calculator 13 thus determines a linear prediction coefficient $\alpha_i$ (i=1, . . . , 10) in each frame by the Burg analysis, and supplies the linear prediction coefficients $\alpha_i$ to the auditory weight multiplier 16, an impulse response calculator 21, an inverse filter 22 a response signal calculator 51, and a weighting signal calculator 52.

The LSP calculator 13 also converts the linear prediction coefficients $\alpha_i$ to a LSP (Linear Spectrum Pair) parameter suited for subsequent quantization and interpolation, and supplies the LSP parameters to an LSP parameter quantizer 14.

The conversion of linear prediction coefficients $\alpha_i$ to LSP parameters is described in Sugamura et al, "Speech data compression by Linear Spectrum Pair (LSP) speech analysis synthesizing system", The Trans. of IECE Japan, J64-A, 1981, pp. 599–606, and not herein described.

The LSP parameter quantizer 14 determines the LSP parameter giving the minimum values of distortion $D_{s1}$ given by the following formula (1) by retrieving data from a codebook 15.

$$D_{SI} = \sum_{i=1}^{P} W(i)[LSP(i) - QLSP_j(i)]^2 \quad (1)$$

where LSP(i), QLSPj(i) and W(i) are i-th LSP parameter before the quantization, i-th result of the quantization and the i-th weight coefficient, respectively. Efficient LSP parameter quantization is thus obtainable in each frame.

The LSP parameter quantizer 14 decodes the quantized LSP parameter into decoded linear prediction coefficient $\alpha_i'$ (i=1, . . . , P), and supplies this coefficient $\alpha_i'$ to the impulse response calculator 21, the inverse filter 22, the response signal calculator 51 and the weighting signal calculator 52.

The LSP parameter quantizer 14 further supplies an index representing a codevector of the quantized LSP parameter to a multiplexer 41.

LSP parameter quantization will now be described on the basis of a well-known example of a quantizing process. This process is specifically disclosed in, for instance, Japanese Laid-Open Patent Publication No. 4-171500, Japanese Laid-Open Patent Publication No. 4-363000 and Japanese Patent Laid-Open Publication No. 5-6199.

As a further reference, T. Nomura et al, "LSP coding using VQ-SVQ with interpolation in 4,075 kbps M-CLELP speech coder", Proc. Mobile Multimedia Communications, pp. B. 2.5, 1993), for instance, may be referred to, and the process is not herein described in details.

For an input signal x(n), the pitch parameter calculator 17 determines a delay time T giving the minimum distortion $D_{T1}$ in the following formula (2).

$$D_{TI} = \sum_{n=0}^{N-1} x^2(n) - \left[\sum_{n=0}^{N-1} x(n)x(n-T)\right]^2 \Big/ \left[\sum_{n=0}^{N-1} x^2(n-T)\right] \quad (2)$$

where x(n−T) is a speech signal at a pitch of the delay T with respect to the input signal X(n).

The pitch parameter calculator 17 then determines pitch gain β given by following formula (3) according to the delay T for the quantization.

$$\beta = \sum_{n=0}^{N-1} x(n)x(n-T) \Big/ \sum_{n=0}^{N-1} x^2(n-T) \quad (3)$$

and quantizes the pitch gain β.

More specifically, the pitch parameter calculator 17 determines the optimum delay T by integral sample value optimization corresponding to the pitch of the input signal x(n), and supplies an index of the optimum delay T to the multiplexer 41.

Then the pitch parameter calculator 17 determines the pitch gain β by quantization according to the optimum delay T, and supplies an index of the pitch gain p to the multiplexer 41.

The pitch parameter calculator 17 further supplies the delay T and quantized pitch gain β to the impulse response calculator 21, the inverse filter 22, the response signal calculator 51 and the weighting signal calculator 52.

As an alternative, the pitch parameter calculator 17 may determine the optimum delay T by decimal sample value optimization. In this case, the accuracy of determination of the optimum delay T may be improved with speech signals greatly containing high frequency components such as those of women and children. Details in this connection are described in, for instance, P. Kroon et al, "Pitch calculators with high temporal resolution", Proc. ICASSP, 1990, pp. 661–664, and are not herein described.

The impulse response calculator 21 has a filter of transfer function Hi(z) given by the following formula (4).

$$H_1(z) = \frac{1 - \sum_{i=1}^{P} \alpha_i \gamma_1^i Z^{-i}}{\left[1 - \sum_{i=1}^{P} \alpha_i \gamma_2^i Z^{-i}\right]\left[1 - \sum_{i=1}^{P} \alpha_i' Z^{-i}\right][1 - \beta Z^{-T}]} \quad (4)$$

where γ is a weight coefficient for controlling the auditory weight. The impulse response calculator 21 calculates an impulse response of the filter of the transfer function Hi(z) according to the received linear prediction coefficient $\alpha_i$, decoded linear prediction coefficient $\alpha_i'$ obtained by quantizing the linear prediction coefficient $\alpha_i$ and the optimum delay T and pitch gain β noted above, and supplies the result to a second orthogonal transform circuit 25.

The response signal calculator 51 determines response signal $x_z(n)$ according to the introduced linear prediction coefficient $\alpha_i$, decoded linear prediction coefficient $\alpha_i'$0 and also the optimum delay T and pitch gain β.

More specifically, the response impulse calculator 51 determines, from numerical values preserved in a filter memory, the response signal $x_z(n)$ for one frame when the input signal d(n) given by following formula (5) is set to d(n)=0, and supplies the result to a subtractor 23.

$$X_2(N) = d(n) - \sum_{i=1}^{P} \alpha_i \gamma_1^i d(n-i) + \sum_{i=1}^{P} \alpha_i \gamma_2^i y(n-i) + \sum_{i=1}^{P} \alpha_i' X_2(n-i) \quad (5)$$

When (n−i)≦0, the following formulas (6) and (7) are satisfied.

$$y(n-i)=p(N+(n-i)) \quad (6)$$

$$x_z(n-i)=s_w(N+(n-i)) \quad (7)$$

where N is the frame length, $s_w(n)$ is a weight output signal from the weight signal calculator 52, and p(n) is an output signal given by the right side third term of the formula (5).

The auditory weighter 16 has a filter of transfer function W(z) given by formula (8). (8)

More specifically, the auditory weighter 16 determines auditory weighted difference signal $x_w(n)$ given by the formula (8) from each frame speech signal received by filtering thereof with the transfer function W(z), and supplies the result to the subtracter 23.

$$W(z) = \frac{1 - \sum_{i=1}^{P} \alpha_i \gamma_1^i z^{-i}}{1 - \sum_{i=1}^{P} \alpha_i \gamma_2^i z^{-i}} \quad (8)$$

The subtracter 23 obtains auditory weighted subtraction signal $x_w(n)'$ from the perceptual weight signal $x_w(n)$ according to the received response signal $x_z(n)$, and supplies the perceptual weight multiplied subtraction signal $x_w(n)'$ to the inverse filter 22.

That is, the subtracter 23 subtracts the response signal $x_z(n)$ for one frame from the perceptual weight signal $x_w(n)$ as shown in following formula (9).

$$x_w(n)'=x_w(n)-x_z(n) \tag{9}$$

The inverse filter 22 is a filter having transfer function $F_1(z)$ given by the following formula (10).

$$F_1(z) = \frac{1-\sum_{i=1}^{P}\alpha_i\gamma_2^i z^{-i}}{1-\sum_{i=1}^{P}\alpha_i\gamma_1^i z^{-i}}\left[1-\sum_{i=1}^{P}\alpha_i' z^{-i}\right][1-\beta z^{-T}] \tag{10}$$

More specifically, the inverse filter 22 obtains first inverse filter output signal $e_1(n)$ by passing the received perceptual weight multiplied subtraction signal $x_w(n)'$, linear prediction coefficient $\alpha_i$, decoded linear prediction coefficient $\alpha_i'$ the optimum delay T and pitch gain β noted above, and supplies the first inverse filter output signal $e_1(n)$ to a first orthogonal transform circuit 24.

The first orthogonal transform circuit 24 executes an orthogonal transform of the received first inverse filter output signal $e_1(n)$. For example, the first orthogonal transform circuit 24 obtains first transform signal E(k) (k=0, . . . , N−1) by the DCT transform, and supplies the first transform signal E(k) to a first pulse quantizer 30 and a first gain quantizer 42.

The DCT transform is described in, for instance, J. Tribolet et al, "Frequency domain coding of speech", IEEE Trans. ASSP, Vol. ASSP-27, 1979, pp. 512–530, and not herein described.

The second orthogonal transform circuit 25 calculates an autocorrelation function r(i) (i=0, . . . , N−1) from the received impulse response, then calculates a second transform signal R(k) (k=0, . . . , N−1) by performing N point DCT transform of the autocorrelation transform r(i), and supplies the result to the first pulse quantizer 30 and first gain quantizer 42.

The first pulse quantizer 30 determines a predetermined number of pulse positions minimizing the value of distortion $D_{P1}$ given by the following formula (11) by retrieving the pulse positions on the basis of the first and second transform signals E(k) and R(k).

$$D_{P1} = \sum_{K=1}^{N-1} R(K)\left[E(K) - G\sum_{i=1}^{M}\delta(n-m_i)\right]^2 \tag{11}$$

where G is the gain of pulse at each pulse position, $m_i$ is m-th pulse position, and δ is the delta function.

The first pulse quantizer 30 also supplies the determined pulse positions to the first gain quantizer 42, codes these pulse positions with a predetermined number of bits, and supplies the result to the multiplexer 41.

The pulse position index data and the computational effort necessary for the retrieval can be reduced by limiting the pulse positions to be retrieved to a predetermined number of candidates.

For example, in the case of limiting the total number N (N=160) of pulse positions as shown in Table 1 below to M (M=20) pulse retrieval candidates, the pulse positions can be expressed by three bits, and 20 pulses can be entirely specified with at most 60 bits.

TABLE 1

| |
|---|
| 0, 20, 40, 60, 80, 100, 120, 140 |
| 1, 21, 41, 61, 81, 101, 121, 141 |
| 2, 22, 42, 62, 82, 102, 122, 142 |
| . . . |
| 19, 39, 59, 79, 99, 119, 139, 159 |

The first gain quantizer 42 obtains gain codevectors by performing retrieval of a gain codebook 43, and supplies indexes representing these gain codevectors to an excitation signal calculator 53. Also, the first gain quantizer 42 codes the obtained pulse positions each by a predetermined number of bits, and supplies the vector values of the coded pulse positions to the multiplexer 41.

More specifically, the first gain quantizer 42 calculates gain codevectors corresponding to minimum values of distortion $D_{G1}$ given by formula (12).

$$D_{G1} = \sum_{K=0}^{N-1} R(K)\left[E(K) - G_j'\sum_{i=1}^{M}\delta(n-m_i)\right]^2 \tag{12}$$

where $G_i'$ represents j-th codevector.

The excitation signal calculator 53 calculates excitation signal $V_1(K)$ (K=0, . . . , N−1) given by the following formula (13) from gain codevectors.

$$V_i(K) = G_j'\sum_{L=1}^{M}\delta(n-m_i) \tag{13}$$

More specifically, the excitation signal calculator 53 reads out the gain codevectors corresponding to the received indexes, then calculates the excitation signal $V_1(K)$ from the read-out gain codevectors, and supplies the excitation signal $V_1(K)$ to an inverse orthogonal transform circuit 54.

The inverse orthogonal transform circuit 54 obtains inverse transform output signal v(n) by the inverse DCT transform of the excitation signal $V_1(K)$ for N points, and supplies the inverse transform output signal v(n) to the weight signal calculator 52.

The weight signal calculator 52 determines a response signal $s_w(n)$ from the received inverse transform output signal v(n), linear prediction coefficients $\alpha_i$, decoded linear prediction coefficient $\alpha_i'$ the optimum delay T and pitch gain β.

More specifically, the weight signal calculator 52 determines the response signal $s_w(n)$ for each sub-frame as shown in the following formula (14), and supplies the response signal $s_w(n)$ to the response signal calculator 51.

$$s_w(n) = v(n) - \sum_{i=1}^{P}\alpha_i\gamma_1(n-i) + \sum_{i=1}^{P}\alpha_i\gamma_2 p(n-i) + \sum_{i=1}^{P}\alpha_i' s_w(n-i) + \beta s_w(n-T) \tag{14}$$

Figure 2:
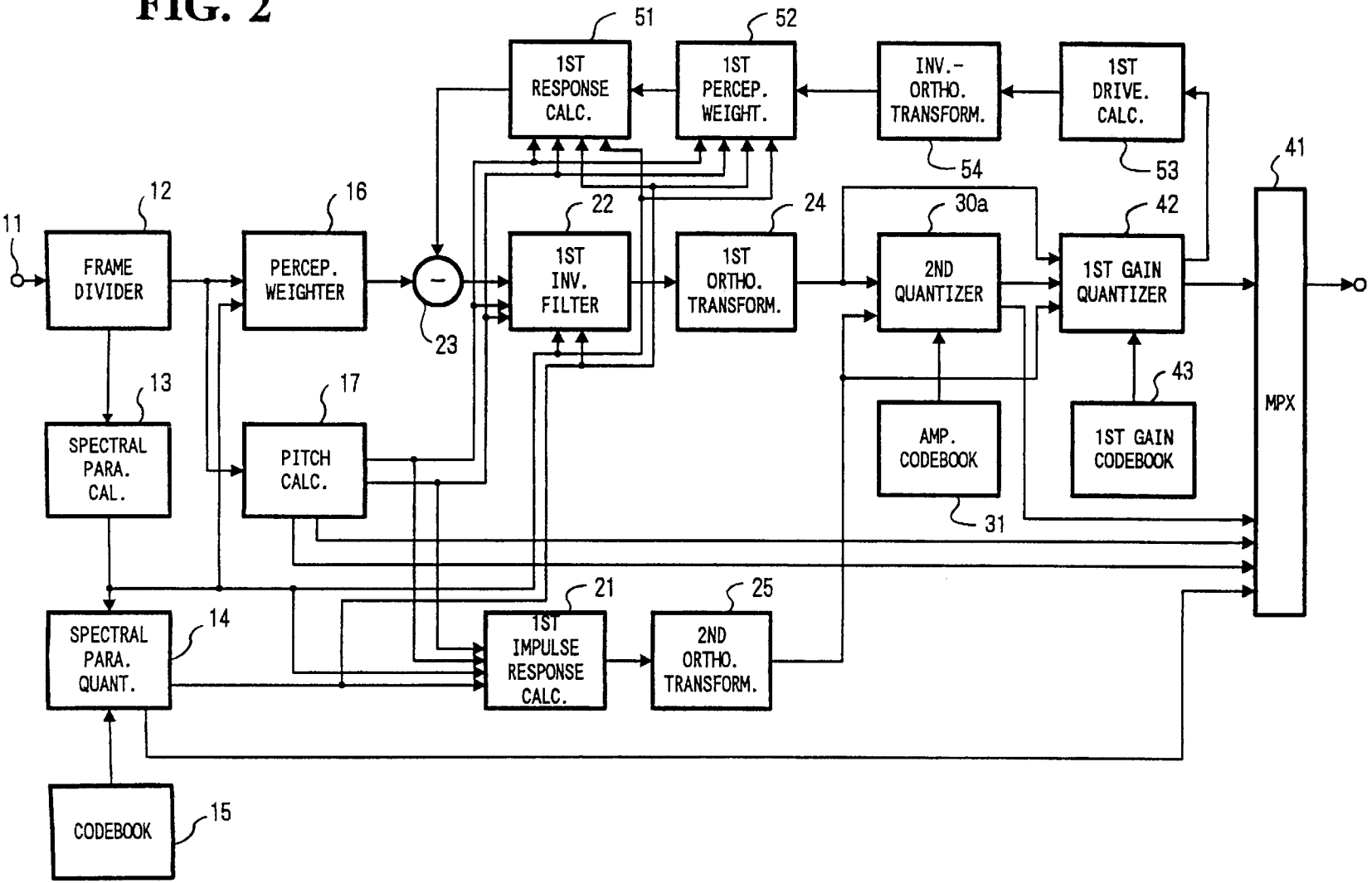
FIG. 2 is a block diagram showing a second embodiment of the invention.

FIG. 2 is a block diagram for describing a second embodiment of the invention.

This second embodiment is different from the first embodiment in that it comprises a second pulse quantizer 30*a*, which is used in lieu of the first pulse quantizer 30 in the first embodiment and includes an amplitude codebook 31.

The second pulse quantizer 30*a* is the same as the first pulse quantizer 30 except for that it performs retrieval for pulse positions corresponding to minimum values of $D_{P2}$ given by the following formula (15).

$$D_{P2} = \sum_{K=0}^{N-1} R(K)\left[E(K) - G'\sum_{i=1}^{M} sign_i\delta(n-m_i)\right]^2 \tag{15}$$

where $sign_i$ is the sign of the pulse at i-th pulse position, the sign being preliminarily determined by checking the first transform signal E(K).

After the above pulse position retrieval, the second pulse quantizer 30*a* selects amplitude codevectors corresponding to minimum values of distortion $D_{w2}$ given by the following formula (16) by performing retrieval of the amplitude codebook 31, and supplies the selected amplitude codevector to the gain quantizer 42.

$$D_{w2} = \sum_{K=0}^{N-1} R(K)\left[E(K) - G'\sum_{i=1}^{M} A_{ij}\delta(n-m_i)\right]^2 \tag{16}$$

where $A_{ij}$ is j-th amplitude codevector.

The second pulse quantizer 30*a* also codes the obtained pulse positions each by a predetermined number of bits, and supplies the obtained pulse positions to the multiplexer 41.

Figure 3:
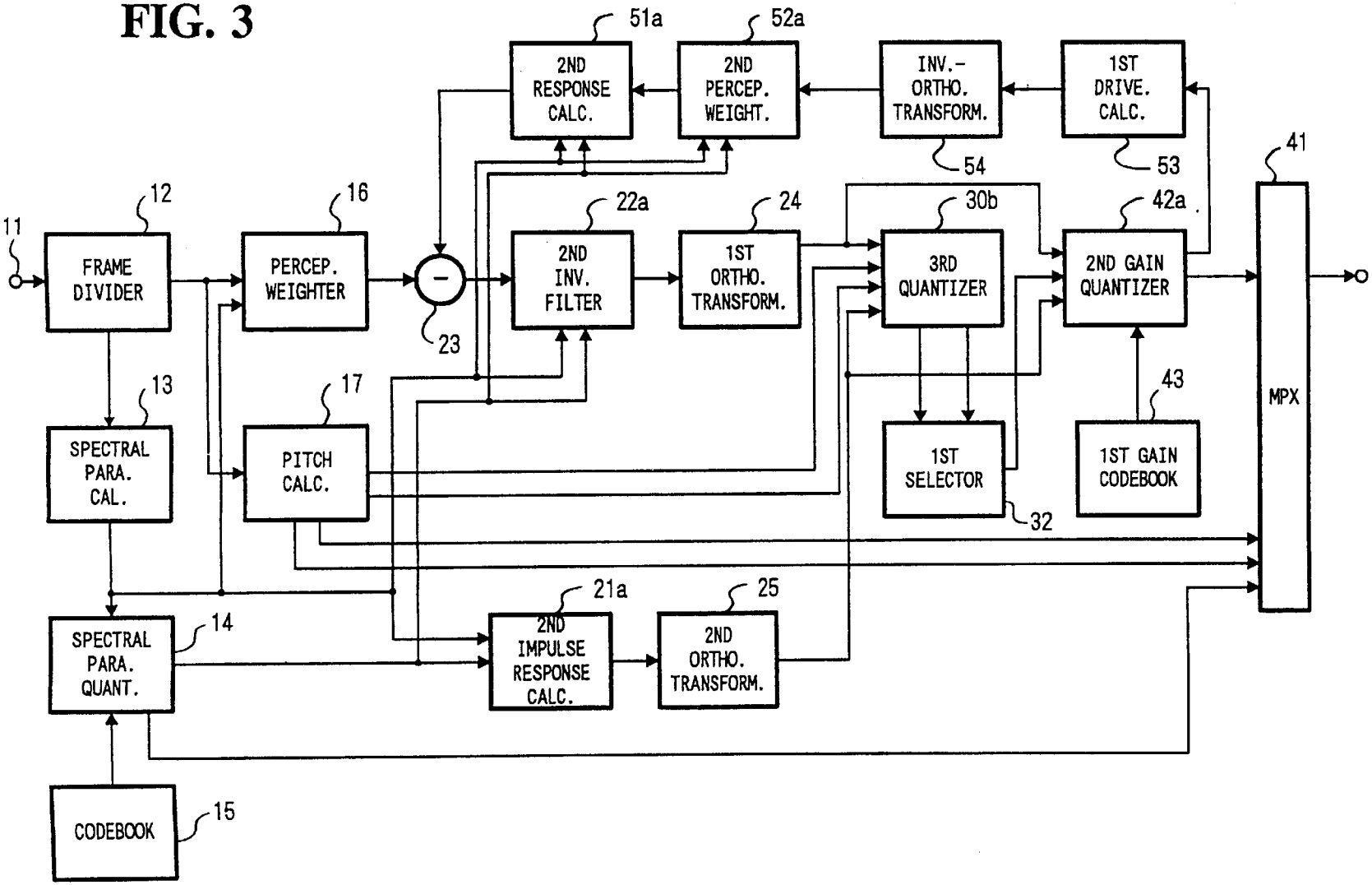
FIG. 3 is a block diagram showing a third embodiment of the invention.

FIG. 3 is a block diagram showing a third embodiment of the invention.

The third embodiment is different from the first embodiment in that a second impulse response calculator 21*a*, a second inverse filter 22*a* and a second response signal calculator 51*a* are used in lieu of the first impulse response calculator 21, the first inverse filter 22 and the first response signal calculator 51 in the first embodiment, respectively.

In addition, a third pulse quantizer 30 and a second gain quantizer 42*a* are used in lieu of the first pulse quantizer 30 and the first gain quantizer 42 in the first embodiment, and a selector 32 for selecting the output of the third pulse quantizer 30*b* is used.

In this embodiment, the pitch calculator 17 supplies the optimum delay T and pitch gain β to the third pulse quantizer 30*b*.

The second impulse response calculator 21*a* is the same as the first impulse response calculator 21 except for that it has a filter of transfer function $H_2(z)$ given by the following formula (17).

$$H_2(z) = H_i(z) \Big/ \left[1 - \sum_{i=1}^{P} \alpha_i' z^{-i}\right] \tag{17}$$

More specifically, the second impulse response calculator 21*a* determines the impulse response by computation with respect to transfer function $H_2(z)$, and the impulse response to the second orthogonal transform circuit 25.

The second inverse filter 22*a* is the same as the first inverse filter 22 except for that it has a filter of transfer function $F_2(Z)$ given by the following formula (18).

$$F_2(z) = \frac{1 - \sum_{i=1}^{P} \alpha_i \gamma_2^i z^{-1}}{1 - \sum_{j=1}^{P} \alpha_i \gamma_2^i z^{-1}}\left[1 - \sum_{i=1}^{P} \alpha_i' z^{-i}\right] \tag{18}$$

More specifically, the second inverse filter 22*a* obtains a second inverse filter output signal $e_2(n)$ by inverse filtering of the auditory weighted difference signal with the transfer function $F_2(z)$, and supplies the second inverse filter output signal $e_2(n)$ to the first orthogonal transform circuit 24.

The third pulse quantizer 30*b* is the same as the first pulse quantizer 30 except for independently making retrieval of a first pulse group according to the received optimum delay T and pitch gain β and retrieval of a second pulse group like that done by the first pulse quantizer 30.

More specifically, the third pulse quantizer 30*b* obtains pitch frequency $f_T$ from the delay T, and multiplies pulses at positions spaced apart by the pitch frequency T by the pitch gain β. The third pulse quantizer 30*b* retrieves the pulses by repeating these operations.

The third pulse quantizer 30*b* calculates the distortion $D_{P2}$ of the pulses and determines a predetermined number of pulse positions corresponding to minimum values of the distortion $D_{P2}$, thereby forming the first pulse group, and supplies the pulses in the first pulse group together with the corresponding values of the distortion $D_{P2}$ to the selector 32.

The third pulse quantizer 30*b* also makes retrieval of the pulses without use of the pitch frequency $f_T$ and the pitch gain β, obtains the second pulse group by determining a predetermined number of pulses corresponding to minimum values of the distortion $D_{P2}$ like the first pulse group, and supplies the pulses in the second pulse group together with the corresponding distortion values to the selector 32.

The selector 32 selects either the first or the second pulse group in which the distortion $D_{P2}$ is less, and supplies the selected pulse group to the second gain quantizer 42*a*.

Figure 4:
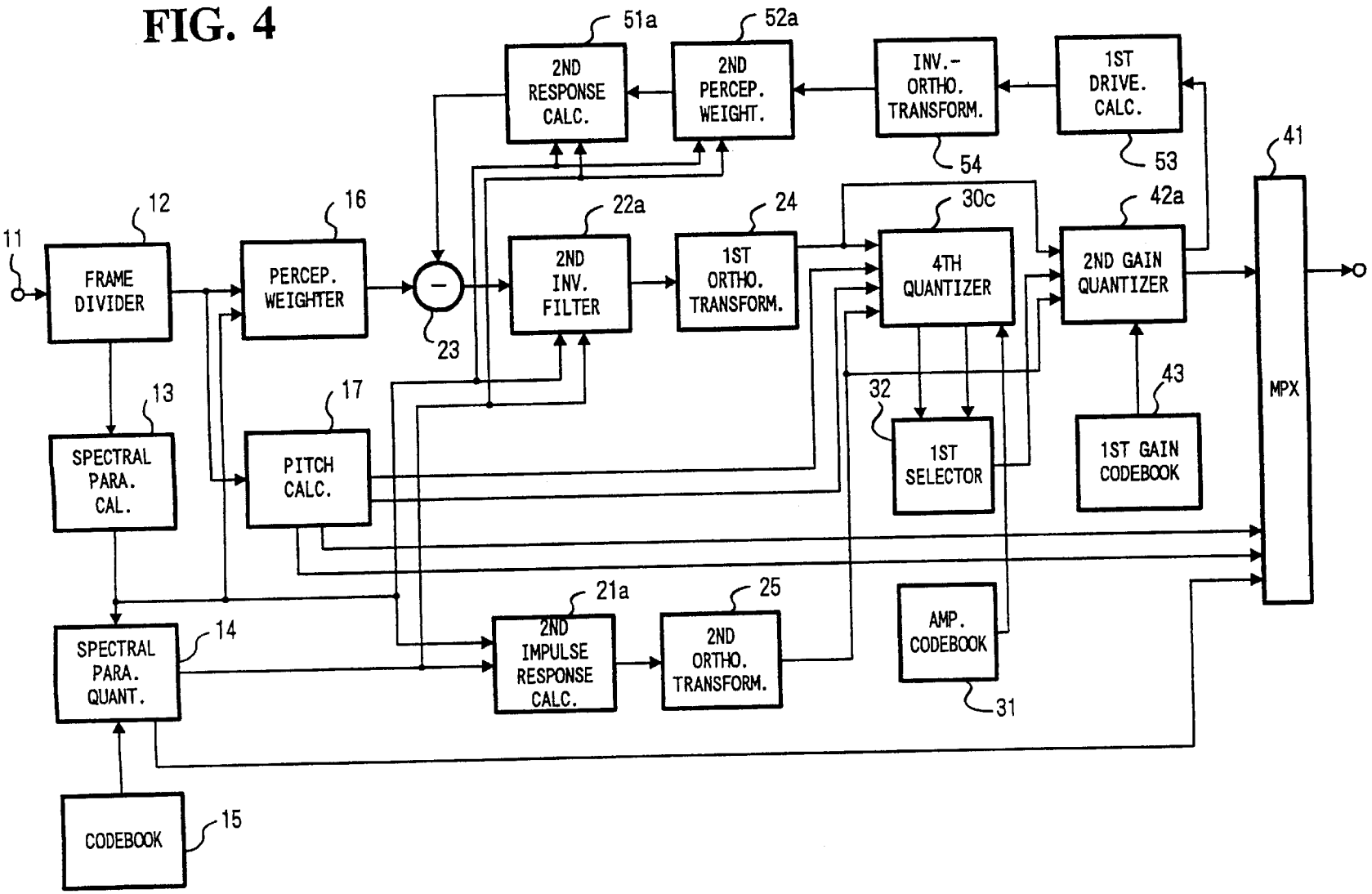
FIG. 4 is a block diagram showing a fourth embodiment of the invention.

FIG. 4 is a block diagram showing a fourth embodiment of the invention.

The fourth embodiment is different from the third embodiment in that a fourth pulse quantizer 30*c* including an amplitude codebook 31 is used in lieu of the third pulse quantizer 30*b* in the third embodiment.

The fourth pulse quantizer 30*c* is the same as the third pulse quantizer 30*b* except for that it uses the amplitude codebook 31 when extracting the first and second pulse groups by the pulse position retrieval. The fourth pulse quantizer 30*c* can retrieve for optimum amplitude codevectors with the amplitude codebook 31.

The selector 32 selects either the first or the second pulse group in which the distortion $D_{P2}$ is less, and supplies the selected pulse group to the second gain quantizer 42*a*.

Figure 5:
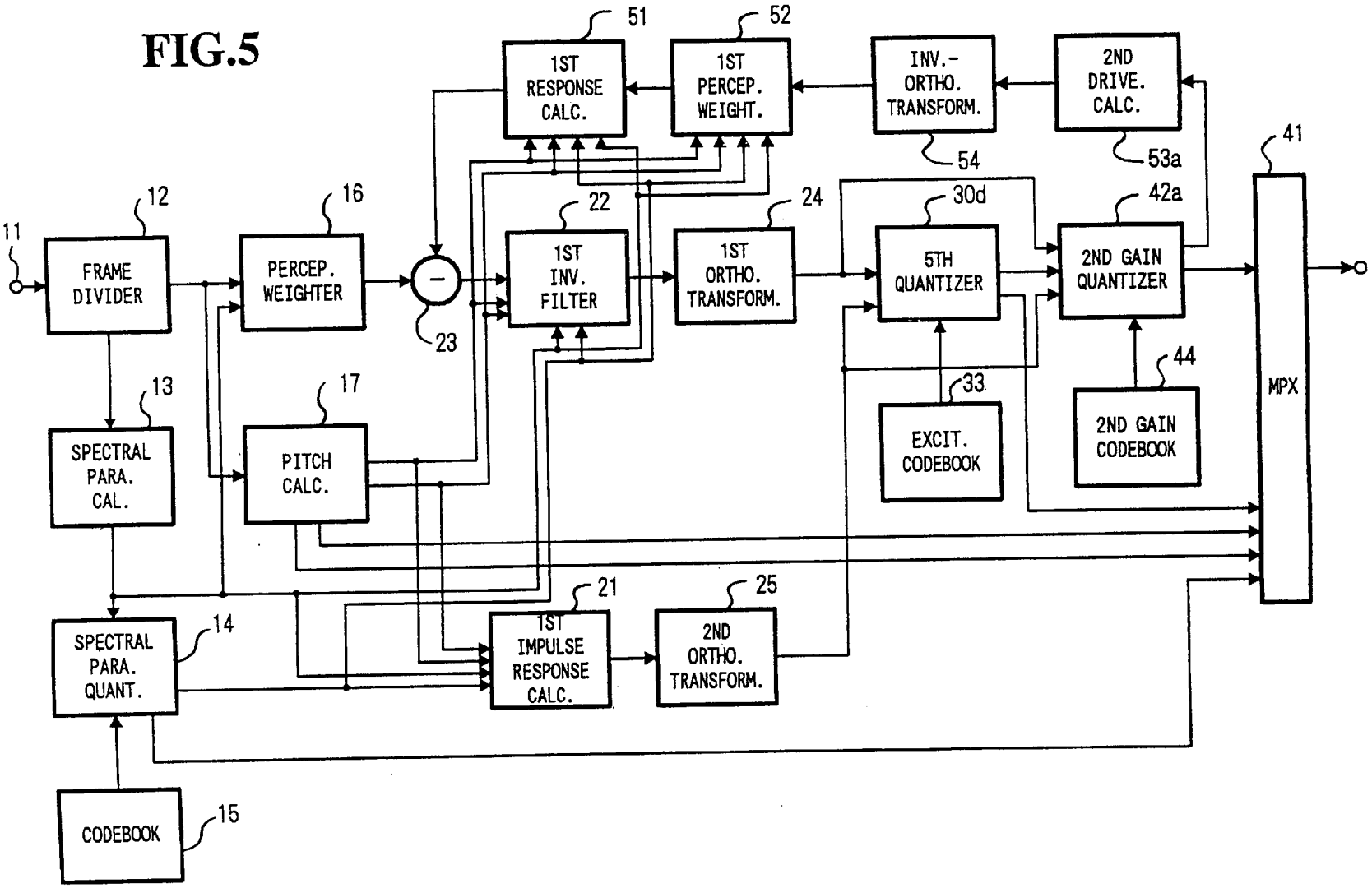
FIG. 5 is a block diagram showing a fifth embodiment of the invention.

FIG. 5 is a block diagram showing a fifth embodiment of the invention.

This fifth embodiment is different from the first embodiment in that a fifth pulse quantizer 30*d* including an excitation codebook 33 and a second gain quantizer 42*a* including a second gain codebook 44, are used respectively in lieu of the first pulse quantizer 30 and the first gain quantizer 42 in the first embodiment.

In the excitation codebook 33 are preliminarily set $2^B$ different excitation codevectors having a predetermined bit number B, and in the second gain codevector 44 are set two-dimensional gain codevectors.

The fifth pulse quantizer 30*d* is the same as the first pulse quantizer 30 except that it uses the excitation codebook 33 when extracting a pulse group of a predetermined pulses by making pulse position retrieval. The fifth pulse quantizer 30*d* can extract optimum excitation codevectors with the excitation codebooks 33.

More specifically, the fifth pulse quantizer 30*d* reads out excitation codevectors from the excitation codebook 33, and selects those corresponding to minimum values of distortion $D_{P5}$ given by the following equation (19).

$$D_{P5} = \sum_{K=0}^{N-1} R(K)\left[E(K) - G_1 \sum_{i=1}^{M} sign_i \delta(n - m_i) - G_2 c_j(K)\right]^2 \quad (19)$$

where $c_j(K)$ is excitation codevector, $G_1$ is the gain of pulse at each pulse position to be retrieved, and $G_2$ is the gain of the excitation codevector $c_j(K)$.

The second gain quantizer 42*a* is the same as the first gain quantizer 42 except for that it makes retrieval of the second gain codebook 44.

The second gain quantizer 42*a* can extract optimum gain codevectors with the second gain codebook 44, and supplies indexes of the extracted codevectors to the excitation signal calculator 52 and the vector values of the codevectors to the multiplexer 41.

More specifically, the second gain quantizer 42*a* reads out gain codevectors from the second gain code book 44, and selects those corresponding to minimum values of distortion $DG_5$ given by the following formula (20).

$$D_{G5} = \sum_{K=0}^{N-1} R(K)\left[E(K) - G'_{1j} \sum_{i=1}^{M} \delta(n - m_i) - G'_{2j} c_j(K)\right]^2 \quad (20)$$

where $G_{1j}$ and $G_{2j}'$ are elements of a j-th gain codevector in the second gain codebook.

The second gain signal calculator 53*a* is the same as the first excitation signal calculator 53 except that it reads out gain codevectors corresponding to the received indexes, obtains excitation signal $V_5$ (K)according to formula (21), and supplies the excitation signal $V_5(K)$ to inverse orthogonal transform circuit 54.

$$V_5(K) = G'_{1j} \sum_{i=1}^{M} \delta(n - m_i) - G'_{2j} c_j(K) \quad (21)$$

Figure 6:
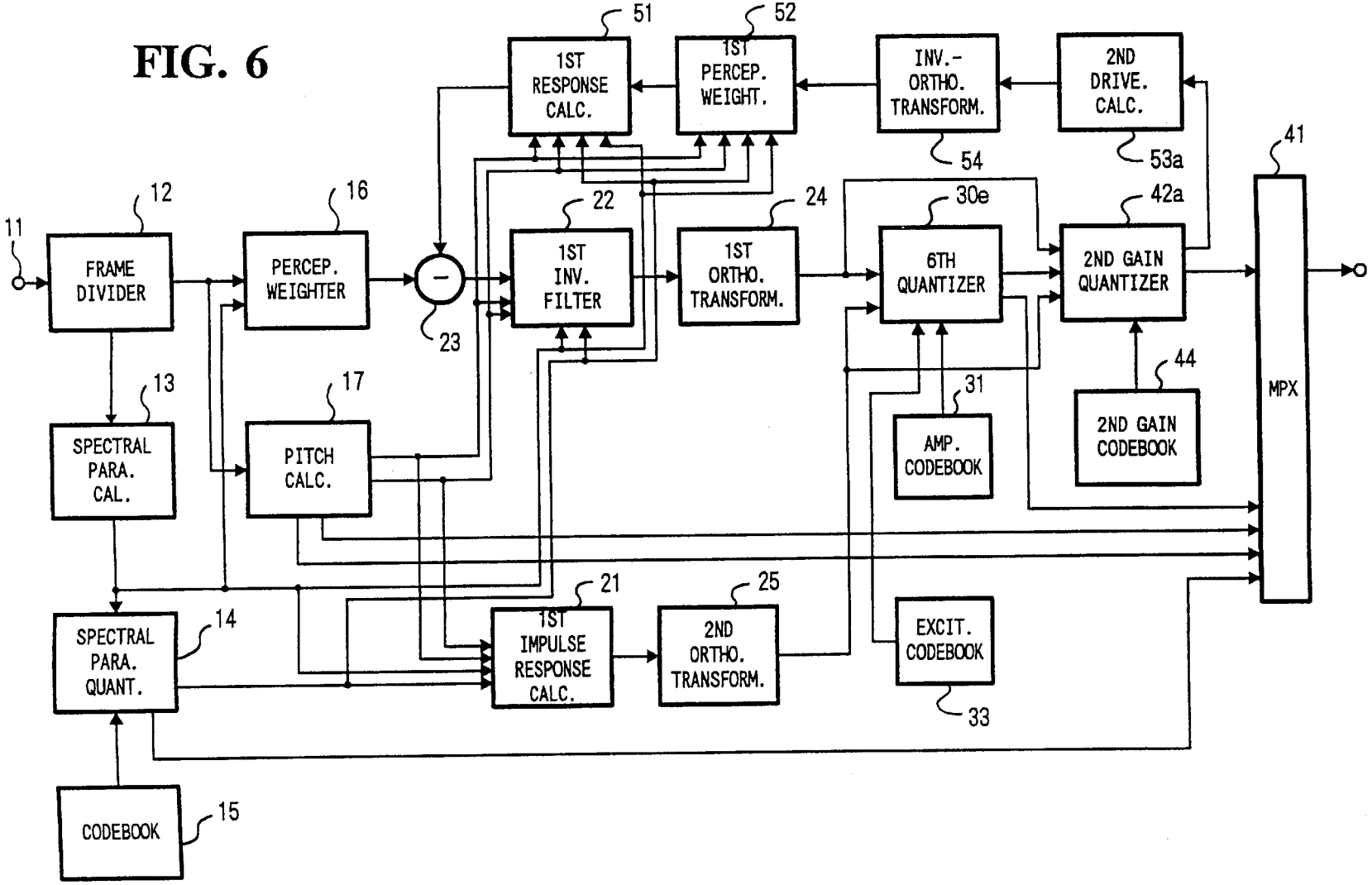
FIG. 6 is a block diagram showing a sixth embodiment of the invention.

FIG. 6 is a block diagram showing a sixth embodiment of the invention.

This sixth embodiment is different from the fifth embodiment in that a sixth pulse quantizer 30*e* is used together with an amplitude codebook 31 and an excitation codebook 33 in lieu of the fifth pulse quantizer 30*a* in the fifth embodiment.

The sixth pulse quantizer 30*e* is the same as the fifth pulse quantizer 30*a* except that it makes retrieval of the amplitude codebook 31 when extracting a pulse group of predetermined pulses by pulse position retrieval. The sixth pulse quantizer 30*d* can quantize pulse amplitudes with the amplitude codevector 31.

The sixth pulse quantizer 30*e* makes retrieval of the excitation codebook 33, and supplies a group of optimum excitation codevectors to the second gain quantizer 42*a* and vector values of these codevectors to the multiplexer 41.

More specifically, the sixth pulse quantizer 30*d* reads out excitation codevectors from the excitation codevector 33, and selects those corresponding to minimum values of distortion $D_{w6}$ given by following formula (22).

$$D_{W6} = \sum_{K=0}^{N-1} R(K)\left[E(K) - G_{1j} \sum_{i=1}^{M} A_i \delta(n - m_i) - G_{2j} c_j(K)\right]^2 \quad (22)$$

where $A_i$ is i-th amplitude codevector.

The second gain quantizer 42*a* is the same as the first gain quantizer 42 except for it makes retrieval of the second gain codevector 44.

The second gain quantizer 42*a* can determine optimum gain codevectors corresponding to minimum values of distortion $D_{G6}$ given by the following formula (23) with the second gain codevector 44, and supplies indexes of the determined codevectors to the second excitation signal calculator 53*a* and vector values of these codevectors to the multiplexer 41.

$$D_{G6} = \sum_{K=0}^{N-1} R(K)\left[E(K) - G'_{1j} \sum_{i=1}^{M} A_I \delta(n - m_i) - G'_{2j} c_i(K)\right]^2 \quad (23)$$

The second excitation signal calculator 53*a* is the same as the first excitation signal calculator 53 except that it obtains excitation signal $V_6(K)$ by reading out gain codevectors corresponding to the received indexes and supplies the obtained excitation signal $V_6(K)$ to the inverse orthogonal transform circuit 54.

$$V_6(K) = G'_{1j} \sum_{i=1}^{M} A_i \delta(n - m_i) + G'_{2j} c_j(K) \quad (24)$$

Figure 7:
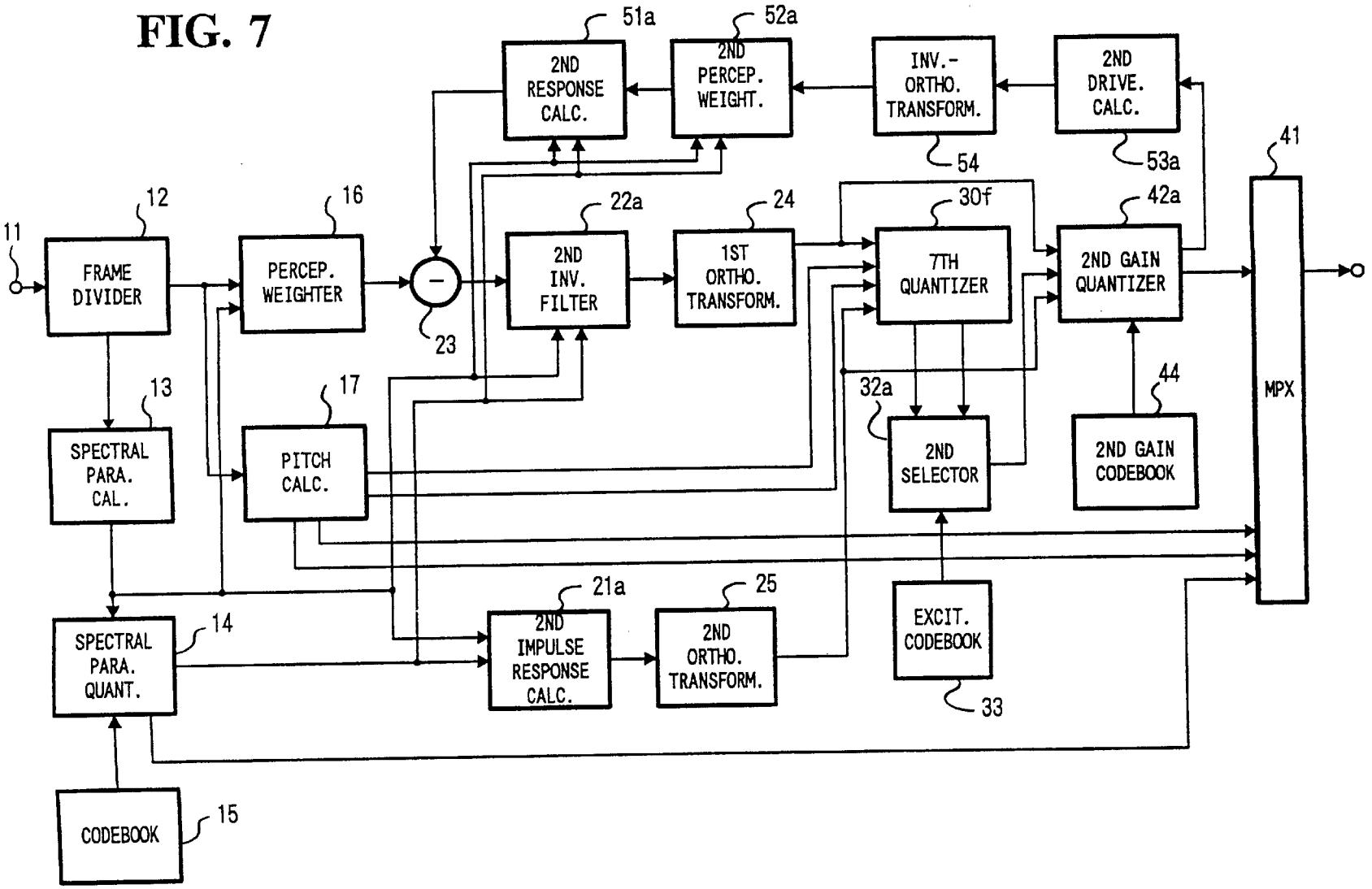
FIG. 7 is a block diagram showing a seventh embodiment of the invention.

FIG. 7 is a block diagram showing a seventh embodiment of the invention.

This seventh embodiment is different from the third embodiment in that a second selector 32*a* including an excitation codebook 33, a second gain quantizer 42*a* including a second gain codebook 44 and a second excitation signal calculator 53*a* are used respectively, in lieu of the first selector 32, the first gain quantizer 42 and the first excitation signal calculator 53 in the third embodiment.

The second selector 32*a* is the same as the first selector 32 except that it retrieves sets of pulses and codevectors corresponding to minimum values of distortion $D_{P2}$ given by formula (25).

$$D_{P7} = \sum_{K=0}^{N-1} R(K)\left[E(K) - G_1 \sum_{i=1}^{M} sign_i \delta(n - m_i) - G_2 c_j(K)\right]^2 \quad (25)$$

More specifically, the second selector 32*a* selects either the first or the second pulse group received in which the distortion $D_{P2}$ is less, then selects optimum sets, and supplies these sets to the second gain quantizer 42*a*.

Figure 8:
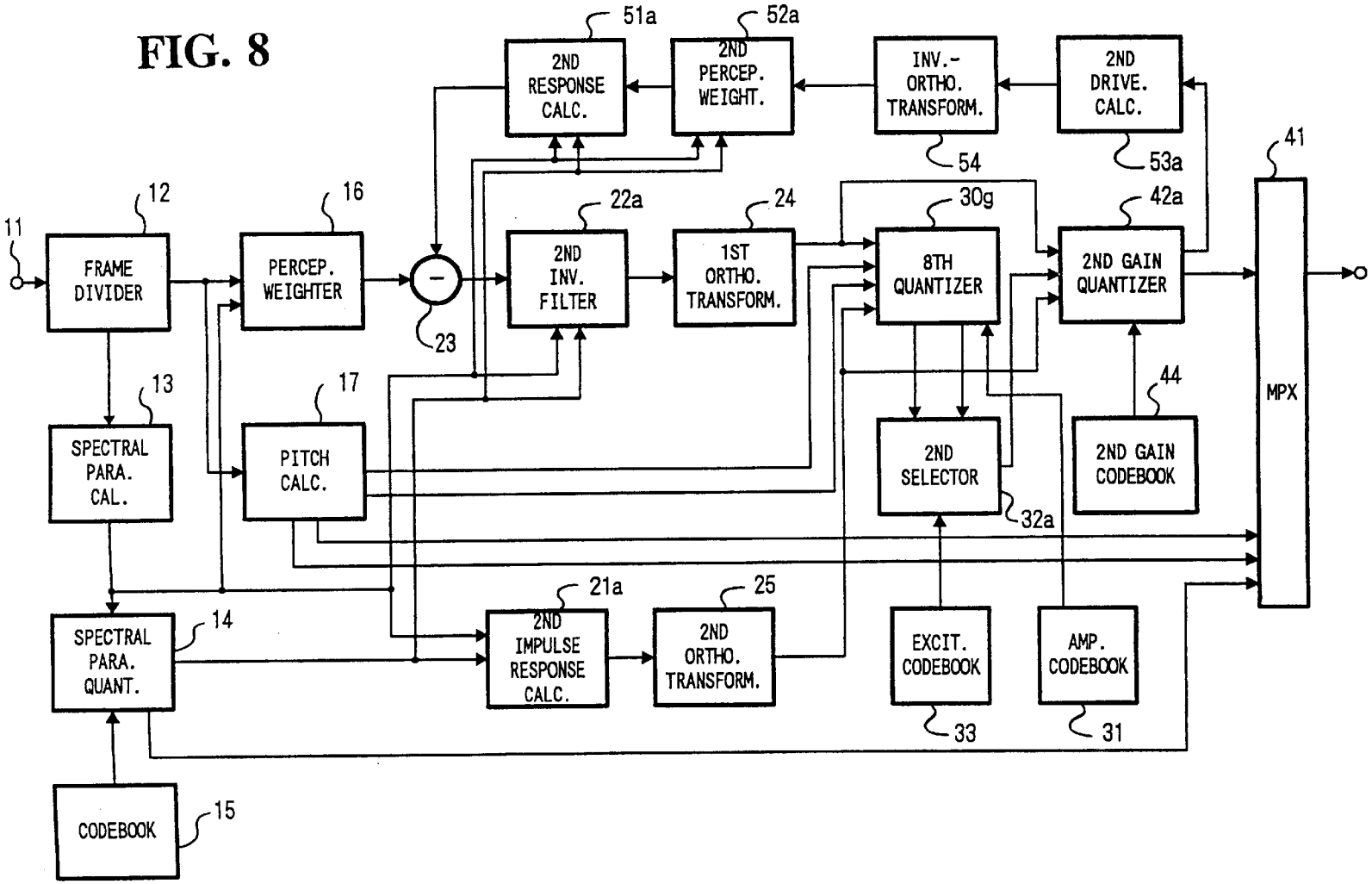
FIG. 8 is a block diagram showing an eighth embodiment of the invention.

FIG. 8 is a block diagram showing an eighth embodiment of the invention.

This eighth embodiment is different from the seventh embodiment in that an eighth pulse quantizer 30*g* is used together with a second selector 32*a* and an amplitude codebook 31 in lieu of the seventh pulse quantizer 30*f* in the seventh embodiment.

The eighth pulse quantizer 30*g* is the same as the seventh pulse quantizer 30*f* except that it makes retrieval of the amplitude codebook 31 when extracting the first and second pulse groups. The eighth pulse quantizer 30*g* can obtain optimum amplitude codevectors with the amplitude codebook 31, and supplies the obtained amplitude codevectors together with corresponding values of the distortion $D_{P2}$ to the second selector 32*a*.

The second selector 32*a* selects either the first or the second pulse group in which the distortion $D_{P2}$ is less, and then selects codevectors corresponding to minimum values of distortion $D_{P8}$ given by the following formula (26) by retrieval of the excitation codebook 33 for the selected sets of pulses and amplitude codevectors.

$$D_{P8} = \sum_{K=0}^{N-1} R(K)\left[E(K) - G_1 \sum_{i=1}^{M} A_i \delta(n - m_i) - G_2 c_j(K)\right]^2 \quad (26)$$

The second selector 32*a* further supplies the selected sets of pulses, amplitude codevectors and excitation codevectors to the second gain quantizer 42*a*.

While in the above embodiments the DCT transform was adopted as orthogonal transfer means, it is possible to adopt other transfer means as well, such as well-known MDCT (Modified DCT). In this case, it is possible to simplify the calculations.

As a method of bit number allocation in the LSP quantizer, it is also well known to obtain power spectrum by making orthogonal transform of quantized LSP or spectral parameters and use power ratios of sub-divided intervals for the bit number distribution. In this case, the speech quality effectiveness can be improved.

Furthermore, while in the above embodiments the pulse quantizers quantize the orthogonal transform coefficients for N points, it is also possible to quantize the orthogonal transform coefficients for M sub-division points concerning the N points.

Yet further, in the fourth to eighth embodiments the pulse quantizers may make multiple stage vector quantization when selecting excitation codevectors of pulses by retrieving the excitation codebook. In this case, the calculations can be further simplified.

Yet further, in the second, fourth, sixth and eighth embodiments the pulse quantizers may allocate the amplitude codebook bit number according to powers on the frequency axis of the speech signal when quantizing the pulse amplitudes by retrieving the amplitude codebook. In this case, it is possible to obtain more effective data reduction.

Yet further, it is possible to predict pulse positions frame by frame from the envelope shape of spectrum obtained from the parameter calculator or the impulse response calculator and collectively quantize at least either the sense or the amplitude of pulses. In this case, it is possible to dispense with transfer of data concerning the pulse positions.

Further changes and modifications in the details of the above embodiments are possible without departing from the scope of the invention.

As has been described in the foregoing, with the signal coder according to the invention the following effects are obtainable.

Firstly, orthogonal transform of the speech signal or a signal derived therefrom is performed to quantize the signal partly or entirely for obtaining a plurality of pulses.

It is thus possible to reduce the data necessary for the transfer of output coefficients.

Secondly, of a first pulse group, which is obtained by recurrent retrieval of pulse positions to be quantized by using pitch frequencies extracted from the input signal, and a second pulse group, which is obtained by retrieval without use of the pitch frequencies, the group corresponding to less distortion is selected.

It is thus possible to obtain optimum pulse group retrieval on the basis of speech signal characteristics.

Thirdly, codevectors read out from the excitation codebook are used together with the pulses obtained by the retrieval as output accompanying quantization.

It is thus possible to quantize even speech signal components which cannot be obtained by sole pulse retrieval and consequently improve the overall speech quality of the quantization output.

Since a speech signal having high frequency components thus can be quantized with less computational effort, it is possible to realize a signal coder, which can realize low bit rate and excellent speech quality coding.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A speech signal coder for coding a speech signal, the speech signal coder comprising:

a parameter calculator which calculates spectral and pitch parameters from the speech signal thereby producing calculated parameters, and quantizes the calculated parameters thereby producing quantized spectral and pitch parameters;

an impulse response calculator having a filter, the impulse response calculator calculates impulse responses of the quantized spectral and pitch parameters by using the filter;

a first orthogonal transform circuit which produces a first transform signal by performing an orthogonal transform of the speech signal using inverse filtering in accordance with the quantized spectral and pitch parameters;

a second orthogonal transform circuit which transforms the impulse responses to produce a second transform signal; and a pulse quantizer which quantizes the first transform signal using the second transform signal.

2. The speech signal coder according to claim 1, wherein:

the pulse quantizer includes a first retrieval unit which determines a first pulse group of a plurality of pulses recurrently based upon the pitch parameters, and a second retrieval unit which determines a second pulse group based upon the second transform signal, and wherein the speech signal coder further comprises a selector which selects either the first or the second pulse group representing the first transform signal.

3. The speech signal coder according to claim 2, wherein the pulse quantizer obtains the plurality of pulses by also using codevectors retrieved from a codebook.

4. The speech signal coder according to claim 1, wherein the pulse quantizer simultaneously quantizes the polarity or amplitude of at least one of the plurality of pulses.

5. A speech signal coder comprising:

a spectral parameter calculator which extracts spectral information from a frame of an input speech signal;

a pitch calculator which extracts pitch information from the frame of the input speech signal;

an impulse response calculator having a first filter, the impulse response calculator determines an impulse response signal of the first filter based on the spectrum information and pitch information;

a response signal calculator having a second filter, the response signal calculator determines a response signal of the second filter based on the spectrum information and pitch information of the input signal and based upon an input response signal;

a subtractor which produces a difference signal representative of the difference between a perceptually weighted signal of the input speech signal and the response signal;

an inverse filter which receives the difference signal and produces an output in response thereto, the inverse filter being defined by the spectrum information and pitch information;

a first orthogonal transform circuit which transforms the output of the inverse filter and produces a first transform signal in response thereto;

a second orthogonal transform circuit which transforms the impulse response signal and produces a second transform signal in response thereto;

a first quantizer which determines a predetermined number of pulse position data based on the first and second transform signals;

a gain quantizer which determines a gain code vector using a gain codebook based on the first and second transform signals, and the pulse position data;

an excitation signal calculator which calculates an excitation signal based on the gain code vector and the pulse position data;

an inverse-orthogonal transform circuit which transforms the excitation signal and produces a first inverse-orthogonal signal as a result; and a weight signal calculator which produces the input response signal based on the first inverse-orthogonal transform signal, the spectrum information and the pitch information.

6. A speech signal coder comprising:

a spectral parameter calculator which extracts spectral information from a frame of an input speech signal;

a pitch calculator which extracts pitch information from the frame of the input speech signal;

an impulse response calculator having a first filter, the impulse response calculator determines an impulse response signal of the first filter based on the spectrum information and pitch information;

a response signal calculator having a second filter, the response signal calculator determines a response signal of the second filter based on the spectrum information and pitch information of the input signal and based upon an input response signal;

a subtractor which produces a difference signal representative of the difference between a perceptually weighted signal of the input speech signal and the response signal;

an inverse filter which receives the difference signal and produces an output in response thereto, the inverse filter being defined by the spectrum information and pitch information;

a first orthogonal transform circuit which transforms the output of the inverse filter and produces a first transform signal in response thereto;

a second orthogonal transform circuit which transforms the impulse response signal and produces a second transform signal in response thereto;

a first quantizer which determines a predetermined number of pulse positions based on the first and second transform signals;

a first quantizer which determines a predetermined number of pulse position data based on the first and second transform signals, the first quantizer further determining an amplitude codevector by using an amplitude codebook;

a gain quantizer which determines a gain code vector using a gain codebook based on the first and second transform signals, the pulse position data, and the amplitude codevector;

an excitation signal calculator which calculates an excitation signal on the basis of the gain code vector;

an inverse-orthogonal transform circuit which transforms the excitation signal and produces a first inverse-orthogonal signal as a result; and a weight signal calculator which produces the input response signal based on the first inverse-orthogonal transform signal, the spectrum information and the pitch information.

7. A speech signal coder comprising:

a spectral parameter calculator which extracts spectral information from a frame of an input speech signal;

a pitch calculator which extracts pitch information from the frame of the input speech signal;

an impulse response calculator having a first filter, the impulse response calculator determines an impulse response signal of the first filter based on the spectrum information;

a response signal calculator having a second filter, the response signal calculator determines a response signal of the second filter based on the spectrum information and pitch information of the input signal and based upon an input response signal;

a subtractor which produces a difference signal representative of the difference between a perceptually weighted signal of the input speech signal and the response signal;

an inverse filter which receives the difference signal and produces an output in response thereto, the inverse filter being defined by the spectrum information and pitch information;

a first orthogonal transform circuit which transforms the output of the inverse filter and produces a first transform signal in response thereto;

a second orthogonal transform circuit which transforms the impulse response signal and produces a second transform signal in response thereto;

a first quantizer which determines a first group of a predetermined number of pulse position data based on the first and second transform signals, the first quantizer further determines a second group of a predetermined number of pulse position data based on the pitch information;

a selector which selects one of the groups which has a smaller distortion;

a gain quantizer which determines a gain code vector using a gain codebook based on the first and second transform signals, and data of the selected pulse group;

an excitation signal calculator which calculates an excitation signal based on the gain code vector;

an inverse-orthogonal transform circuit which transforms the excitation signal and produces a first inverse-orthogonal signal as a result; and a weight signal calculator which produces the input response signal based on the first inverse-orthogonal transform signal, the spectrum information and the pitch information.

8. A speech signal coder comprising:

a spectral parameter calculator which extracts spectral information from a frame of an input speech signal;

a pitch calculator which extracts pitch information from the frame of the input speech signal;

an impulse response calculator having a first filter, the impulse response calculator determines an impulse response signal of the first filter based on the spectrum information;

a response signal calculator having a second filter, the response signal calculator determines a response signal of the second filter based on the spectrum information and pitch information of the input signal and based upon an input response signal;

a subtractor which produces a difference signal representative of the difference between a perceptually weighted signal of the input speech signal and the response signal;

an inverse filter which receives the difference signal and produces an output in response thereto, the inverse filter being defined by the spectrum information and pitch information;

a first orthogonal transform circuit which transforms the output of the inverse filter and produces a first transform signal in response thereto;

a second orthogonal transform circuit which transforms the impulse response signal and produces a second transform signal in response thereto;

a first quantizer which retrieves a first group of a predetermined number of pulse position dated based on the first and second transform signals using an amplitude codebook, the first quantizer further retrieves a second group of a predetermined number of pulse position data based on the determined pitch information by using the amplitude codebook;

a selector which selects one of the groups which as a smaller distortion by using the amplitude codebook;

a gain quantizer which determines a gain code vector using a gain codebook based on the first and second transform signals, and data of the selected pulse group;

an excitation signal calculator which calculates an excitation signal based on the gain code vector;

an inverse-orthogonal transform circuit which transforms the excitation signal and produces a first inverse-orthogonal signal as a result; and a weight signal calculator which produces the input response signal based on the first inverse-orthogonal transform signal, the spectrum information and the pitch information.

9. A speech signal coder comprising:

a spectral parameter calculator which extracts spectral information from a frame of an input speech signal;

a pitch calculator which extracts pitch information from the frame of the input speech signal;

an impulse response calculator having a first filter, the impulse response calculator determines an impulse response signal of the first filter based on the spectrum information and pitch information;

a response signal calculator having a second filter, the response signal calculator determines a response signal of the second filter based on the spectrum information and pitch information of the input signal and based upon an input response signal;

a subtractor which produces a difference signal representative of the difference between a perceptually weighted signal of the input speech signal and the response signal;

an inverse filter which receives the difference signal and produces an output in response thereto, the inverse filter being defined by the spectrum information and pitch information;

a first orthogonal transform circuit which transforms the output of the inverse filter and produces a first transform signal in response thereto;

a second orthogonal transform circuit which transforms the impulse response signal and produces a second transform signal in response thereto;

a first quantizer which retrieves a predetermined number of pulse position data based on the first and second transform signals by using an excitation codebook;

a gain quantizer which determines a gain code vector by using a gain codebook based on the first and second transform signals, and the retrieved pulse position data;

an excitation signal calculator which calculates an excitation signal based on the gain code vector;

an inverse-orthogonal transform circuit which transforms the excitation signal and produces a first inverse-orthogonal signal as a result; and a weight signal calculator which produces the input response signal based on the first inverse-orthogonal transform signal, the spectrum information and the pitch information.

10. A speech signal coder comprising:

a spectral parameter calculator which extracts spectral information from a frame of an input speech signal;

a pitch calculator which extracts pitch information from the frame of the input speech signal;

an impulse response calculator having a first filter, the impulse response calculator determines an impulse response signal of the first filter based on the spectrum information and pitch information;

a response signal calculator having a second filter, the response signal calculator determines a response signal of the second filter based on the spectrum information and pitch information of the input signal and based upon an input response signal;

a subtractor which produces a difference signal representative of the difference between a perceptually weighted signal of the input speech signal and the response signal;

an inverse filter which receives the difference signal and produces an output in response thereto, the inverse filter being defined by the spectrum information and pitch information;

a first orthogonal transform circuit which transforms the output of the inverse filter and produces a first transform signal in response thereto;

a second orthogonal transform circuit which transforms the impulse response signal and produces a second transform signal in response thereto;

a first quantizer which retrieves a predetermined number of pulse position data based on the first and second transform signals by using an excitation codebook;

a gain quantizer which determines a gain code vector by using a gain codebook based on the first and second transform signals, and the retrieved pulse position data;

an excitation signal calculator which calculates an excitation signal based on the gain code vector;

an inverse-orthogonal transform circuit which transforms the excitation signal and produces a first inverse-orthogonal signal as a result; and a weight signal calculator which produces the input response signal based on the first inverse-orthogonal transform signal, the spectrum information and the pitch information.

11. A speech signal coder comprising:

a spectral parameter calculator which extracts spectral information from a frame of an input speech signal;

a pitch calculator which extracts pitch information from the frame of the input speech signal;

an impulse response calculator having a first filter, the impulse response calculator determines an impulse response signal of the first filter based on the spectrum information;

a response signal calculator having a second filter, the response signal calculator determines a response signal of the second filter based on the spectrum information and pitch information of the input signal and based upon an input response signal;

a subtractor which produces a difference signal representative of the difference between a perceptually weighted signal of the input speech signal and the response signal;

an inverse filter which receives the difference signal and produces an output in response thereto, the inverse filter being defined by the spectrum information and pitch information;

a first orthogonal transform circuit which transforms the output of the inverse filter and produces a first transform signal in response thereto;

a second orthogonal transform circuit which transforms the impulse response signal and produces a second transform signal in response thereto;

a first quantizer which determines a first group of a predetermined number of pulse position data based on the first and second transform signals, the first quantizer further determines a second group of a predetermined number of pulse position data based on the pitch information;

a selector which selects one of the pulse groups that has a smaller distortion by using an excitation codebook;

a gain quantizer which determines a gain code vector using a gain codebook based on the first and second transform signals, and data of the selected pulse group;

an excitation signal calculator which calculates an excitation signal based on the gain code vector;

an inverse-orthogonal transform circuit which transforms the excitation signal and produces a first inverse-orthogonal signal as a result; and a weight signal calculator which produces the input response signal based on the first inverse-orthogonal transform signal, the spectrum information and the pitch information.

12. A speech signal coder comprising:

a spectral parameter calculator which extracts spectral information from a frame of an input speech signal;

a pitch calculator which extracts pitch information from the frame of the input speech signal;

an impulse response calculator having a first filter, the impulse response calculator determines an impulse response signal of the first filter based on the spectrum information and pitch information;

a response signal calculator having a second filter, the response signal calculator determines a response signal of the second filter based on the spectrum information and pitch information of the input signal and based upon an input response signal;

a subtractor which produces a difference signal representative of the difference between a perceptually weighted signal of the input speech signal and the response signal;

an inverse filter which receives the difference signal and produces an output in response thereto, the inverse filter being defined by the spectrum information and pitch information;

a first orthogonal transform circuit which transforms the output of the inverse filter and produces a first transform signal in response thereto;

a second orthogonal transform circuit which transforms the impulse response signal and produces a second transform signal in response thereto;

a first quantizer which determines a first group of a predetermined number of pulse position data based on the first and second transform signals, the first quantizer further determines a second group of a predetermined number of pulse position data based on the pitch information;

a selector which selects one of the groups which has a smaller distortion by using an excitation codebook;

a gain quantizer which determines a gain code vector using a gain codebook based on the first and second transform signals, and data of the selected pulse group;

an excitation signal calculator which calculates an excitation signal based on the gain code vector;

an inverse-orthogonal transform circuit which transforms the excitation signal and produces a first inverse-orthogonal signal as a result; and a weight signal calculator which produces the input response signal based on the first inverse-orthogonal transform signal, the spectrum information and the pitch information.

13. The speech signal coder according to claim 5, wherein the orthogonal transform is DCT or MDCT.

14. The speech signal coder according to of claim 5, wherein the pulse quantization is performed for N points or M sub-division points concerning the N points.

* * * * *